US008643373B2

(12) United States Patent
Wittle

(10) Patent No.: US 8,643,373 B2
(45) Date of Patent: Feb. 4, 2014

(54) ELECTRODE

(75) Inventor: J. Kenneth Wittle, Williamsburg, VA (US)

(73) Assignee: Electro-Petroleum, Inc., Villanova, PA (US)

( * ) Notice: Subject to any disclaimer, the term of this patent is extended or adjusted under 35 U.S.C. 154(b) by 489 days.

(21) Appl. No.: 12/943,239

(22) Filed: Nov. 10, 2010

(65) Prior Publication Data

US 2012/0112753 A1 May 10, 2012

(51) Int. Cl.
*G01V 3/18* (2006.01)
*E21B 47/10* (2012.01)

(52) U.S. Cl.
USPC ..... 324/347; 73/152.18

(58) Field of Classification Search
None
See application file for complete search history.

(56) References Cited

U.S. PATENT DOCUMENTS

| | | | | |
|---|---|---|---|---|
| 3,185,849 | A | 5/1965 | Hoyer et al. | |
| 3,211,220 | A | 10/1965 | Sarapuu | |
| 4,461,997 | A * | 7/1984 | Ohmer | 324/338 |
| 4,495,990 | A | 1/1985 | Titus | |
| 4,537,067 | A * | 8/1985 | Sharp et al. | 73/152.13 |
| 4,733,124 | A * | 3/1988 | Oguro et al. | 313/341 |
| 5,080,773 | A | 1/1992 | Tatum, Jr. et al. | |
| 5,620,049 | A | 4/1997 | Gipson | |
| 6,283,211 | B1 | 9/2001 | Vloedman | |
| 7,095,233 | B1 * | 8/2006 | Tabanou et al. | 324/369 |
| 7,325,604 | B2 | 2/2008 | Wittle | |
| 7,716,978 | B2 * | 5/2010 | Tchakarov et al. | 73/152.18 |
| 2011/0267922 | A1 * | 11/2011 | Shampine et al. | 367/25 |

OTHER PUBLICATIONS

Virwani et al., "Understanding Sub-20 nm Breakdown Behavior of Liquid Dielectrics", Physical Review Letters, PRL 99, 017601 (2007).
Vogelsang et al., "Electric tree propagation along barrier-interfaces in epoxy resin", Conference on Electrical Insulation and Dielectric Phenomena, CEIDP 2002.
Yamada et al., "Electrical breakdown time delay and breakdown propagation velocity in polypropylene under a highly non-uniform field condition", Rapid Communication, J. Phys. D: Appl. Phys. 26 (1993) pp. 1328-1330.
Patrissi et al., Paper appearing in Conduction and Breakdown in Dielectric Liquids, 1993., ICDL '93., IEEE 11th International Conference.
Beroual, "Behavior of charged and uncharged bubbles in dielectric liquids subjected to electric stress", J. Appl. phys. 71 (3), Feb. 1, 1992,pp. 1142-1145.
Yamada et al., "Studies of the breakdown process in dielectric liquids using high speed photography", http://www.sayedsaad.com/High_voltge/files/introduction_2.htm ; Feb. 12, 2003 ; 15 pages.

* cited by examiner

*Primary Examiner* — Jermele M Hollington
*Assistant Examiner* — Trung Nguyen
(74) *Attorney, Agent, or Firm* — Stephen H. Eland; Dann, Dorfman, Herrell & Skillman, P.C.

(57) ABSTRACT

An electrode for enhancing electrical conductivity between an oil or gas field downhole and the surrounding formation. The electrode may serve as a cathode to cooperate with a remote anode to produce an electric field through the formation. The electrode has an electrically conductive, elongated body with a proximal end adapted to be inserted into the production pipe and a distal end adapted to project into the formation. The body of the electrode has a series of radially-projecting flexible filaments. The filaments are composed of an electrically conductive material and are supported by the body so as to be electrically charged. At least one of the filaments project outwardly into engagement with the wall of the downhole. The filaments also project radially outward into the consolidated formation.

18 Claims, 5 Drawing Sheets

ELECTRODE

FIELD OF INVENTION

The present invention relates to apparatus for enhancing the production of oil from subterranean oil reservoirs with the aid of electric current and, in particular, apparatus for enhancing the performance of the method described in U.S. Pat. No. 7,325,604, issued Feb. 5, 2008, the entire contents of which are incorporated herein by reference.

BACKGROUND OF THE INVENTION

As set forth in more detail in U.S. Pat. No. 7,325,604, the oil bearing formation is tapped by drilling a downhole into the oil-bearing formation and providing an open end for the removal of oil. It has been found that the production of oil is enhanced by connecting a negative electrode to the open end and introducing a second electrode in proximity to the formation. A voltage difference is established between the first and second electrodes to create an electric field across the formation. The patent illustrates a downhole into a unconsolidated formation and includes a production pipe which lines the downhole where it enters the unconsolidated formation. In the patent, the terminal end of the production pipe serves as a cathode which cooperates with the second electrode serving as an anode. In consolidated formations, the downhole is drilled and the downhole serves as a conduit for the production of the oil. An electrode is mounted within the consolidated formation within the downhole where it enters the consolidated formation to cooperate with the remote electrode to establish an electric field through the formation.

SUMMARY OF THE INVENTION

The present invention provides an improved electrode which may be mounted in the open end of the downhole to enhance the electrical field across the formation.

More specifically, the present invention provides an electrode having a body body having a large plurality of resilient electrically conductive filaments projecting radially outward at each of the proximal and distal ends. In a preferred embodiment, the inner ends of the filaments are interconnected to form a string which extends along the length of the body to provide a continuous electrical path between the filaments at the proximal and distal ends of the body.

In the design of most electrical equipment, the practice is to limit or eliminate any high stress points in which the gradient voltage may lead to a breakdown of the insulating material such as air or dielectric fluid. The present invention recognizes the desirability of proceeding contrary to this practice and to design the electrode to provide a plurality of stress points and thereby enhance the electric field created by the anode and cathode.

More specifically, the present invention uses electrically-conductive filaments which terminate in points within the oil-bearing formation at the tips of the filaments to attract the electric field produced between the anode and cathode.

In an embodiment of the invention for use in unconsolidated formations, where the downhole terminates in a production pipe projecting into the formation, the proximal end of the electrode body is positioned within the end of the production pipe and the pointed ends of the filaments contact and may dig into the interior wall of the production pipe adjacent the terminal end thereof to ensure good electrical contact between the electrode and the pipe. The distal end of the electrode body projects into the unconsolidated formation to cooperate with the remote anode to produce the electric field.

In a second embodiment of the invention, the electrode is mounted in the downhole of a consolidated formation and the filaments throughout the length of the electrode provide a cathode to cooperate with the remote anode to establish the electrical field through the formation.

In a preferred embodiment, the inner ends of the filaments are mounted in an electrically-conductive strip to form a string which extends along the outer surface of the body continuously from end to end.

Preferably, the body is hollow to provide an interior flow passage which permits oil to flow from the field to the pump for extraction. In addition, spacing may be provided between the filaments to provide one or more supplemental passages surrounding the body through which oil may flow from the field to the pump.

Although the invention has been developed primarily for the enhancement of production of crude oil from underground formations, it is believed that it is effective to enhance the recovery of other carbonaceous fluids, such as natural gas, from underground formations.

BRIEF DESCRIPTION OF THE DRAWINGS

The invention will be described in greater detail with reference to the accompanying drawings, in which.

DESCRIPTION OF THE PREFERRED EMBODIMENTS

Figure 1:
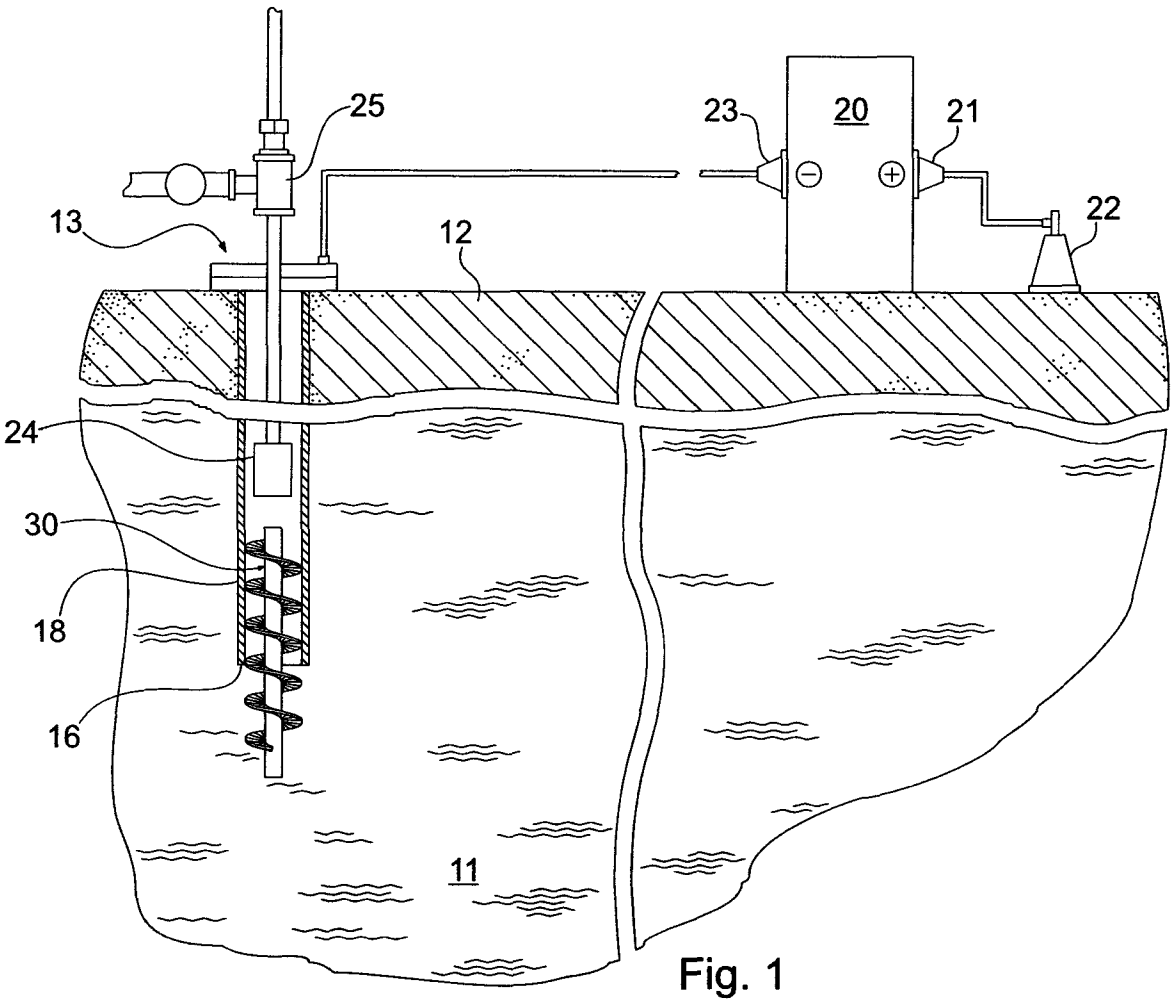
FIG. 1 is a diagrammatic illustration of an oil field embodying an electrode in a production pipe in an unconsolidated formation in accordance with the present invention.

FIG. 1 illustrates an oil-producing well 13 of the type shown in U.S. Pat. No. 7,325,604. The well has a vertical down hole which passes through the overburden 12 into an unconsolidated oil-bearing formation 11. In the illustrated embodiment, the down hole has a production pipe 18 which extends throughout the length of the hole and has a terminal end 16 within the formation 11. As described in detail in U.S. Pat. No. 7,325,604, an electric source 20 has a positive terminal 21 connected to an anode 22 which is preferably of titanium and is embedded in the electric field remote from the well 13. A negative terminal 23 is connected to the pipe so that the terminal end 16 of the pipe serves as a cathode for establishing an electric field through the formation. The terminal end of the pipe is preferably made of stainless steel or another electrically-conductive material. The electric field enhances the flow of oil into the pipe 18 where a pump 24 is operative to pump the oil from the formation to conventional machinery 25 at the head of the well for collecting the oil product for refining and distribution. Although the diagrammatic representation in FIG. 1 shows the pipe 18 within a vertical downhole, the production pipe may extend horizontally or at an angle to penetrate an oil-bearing formation which is remote from the head of the well.

Figure 3:
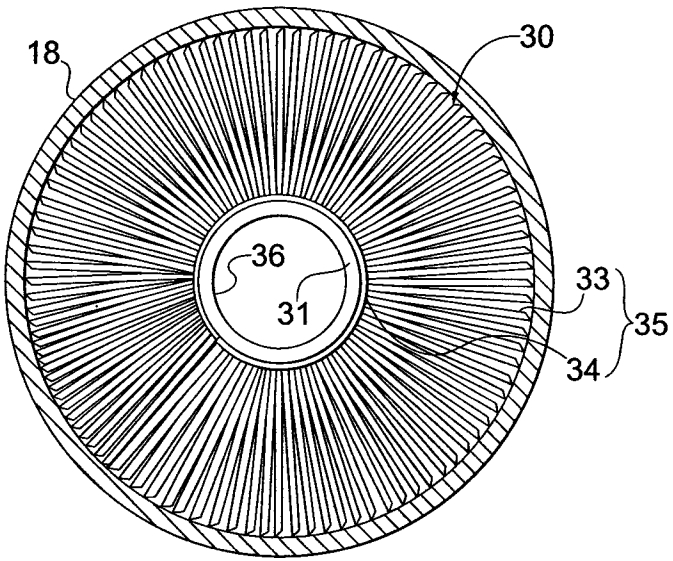
FIG. 3 is a cross sectional view of the production pipe providing a plan view of the electrode shown in FIG. 2.
Figure 2:
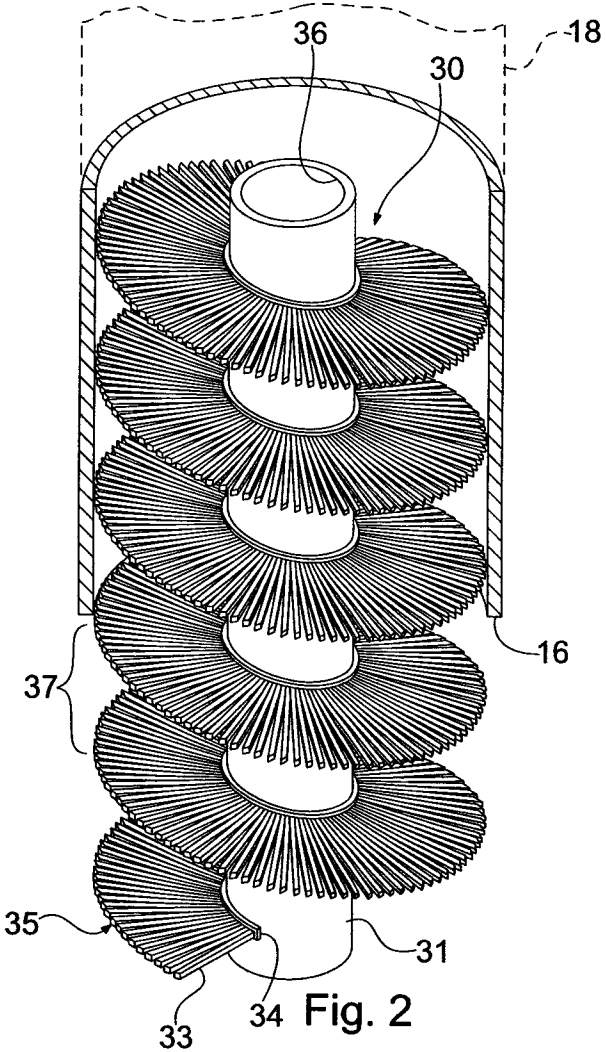
FIG. 2 is an enlarged perspective view of the lower end of the production pipe, with a portion broken away to illustrate the electrode shown in FIG. 1 in which the string of filaments is wound about the body in an open helix.

As shown in FIGS. 1-3, adjacent the terminal end 16 of the pipe 18 an electrode 30 is mounted to project into the unconsolidated formation 11. The electrode 30 comprises a hollow cylindrical body, preferably of an electrically-conductive material, such as stainless steel or another electrically-conductive material. As shown in FIG. 2, the body 31 has a plurality of filaments 33 projecting radially from the body along its length. In the present instance, the filaments are interconnected along their length by a conductive strip 34 to form a string 35 of filaments which is wound helically around the outer circumference of the body 31. As shown in FIGS. 1 and 2, approximately half of the convolutions of the helically-wound string 35 are contained within the pipe 18 and the remaining convolutions extend outwardly into the oil-bearing formation 11. In the illustrated embodiment of the invention, the filaments comprise wires of rectangular cross section free ends are beveled as shown in FIG. 3 to provide a pointed end for engaging the inner surface of the pipe 18 adjacent its terminal end 16.

In accordance with the invention, the beveled ends of the filaments create a plurality of electrical stress points at the outer radial ends of the filaments 33 throughout the length of the electrode 30. The stress points within the terminal end of the pipe 18 are effective to dig into the inner peripheral surface of the pipe 18 to provide a good electrical interconnection between the electrode and the pipe. Within the oil-bearing formation, the terminal ends of the filaments provide a plurality of electrical stress points which attract the electrical charge which provides the electric field within the formation.

In a preferred embodiment, the filaments may be made of standard wire in a round or square configuration and ranging in diameters from very fine to a quarter inch. The ends of the filaments may be beveled by grinding the outer perimeter by the string of filaments after they are wound on the body 31. The filaments may alternatively be formed with individual needle points prior to being assembled into the string 35. The filaments must be sufficiently flexible to flex at their outer ends to conform to any irregularities in the interior surface of the terminal end portion of the pipe 18 but be of sufficient stiffness to insure good electrical contact between the filaments and the pipe.

Although the preferred form of the invention includes the flexible strip 34 mounting the individual filaments, it may be found preferable to form the string 35 in a manner so that the filaments and the strip are integrally united at the inner ends of the filaments, but with sufficient flexibility to enable to string to be wound circumferentially on the body 31.

The presence of the electrode 30 within the terminal end of the pipe 18 may impede the flow of oil from the formation 11 to the pump 24. To minimize the impedance, the hollow interior 36 of the body 31 provides an open flow path from the formation to the pump. An additional flow path is provided by the open winding of the string 35 about the outer perimeter of the body 31. The additional flow path is the helical space 37 between the convolutions of the string 35 in its helical disposition about the body 31.

Figure 5:
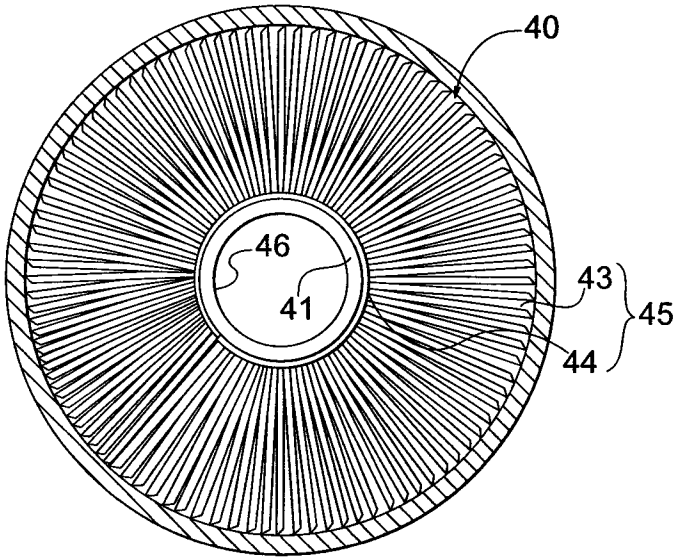
FIG. 5 is a cross sectional view similar to FIG. 3, showing the embodiment shown in FIG. 4.
Figure 4:
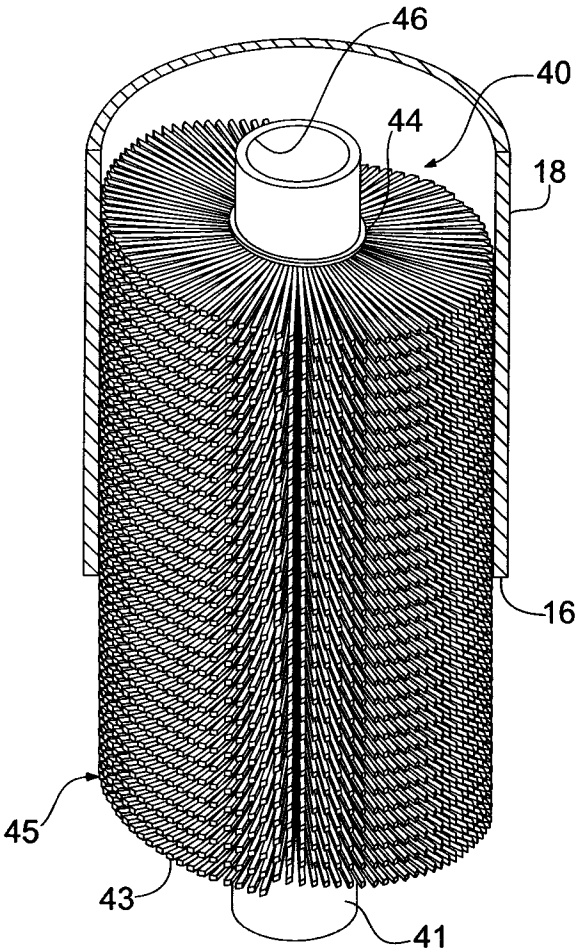
FIG. 4 is a perspective view similar to FIG. 2 of a second embodiment of electrode of the invention in which the string of filaments is wound around the body in a closed helix.

A second embodiment of the invention is illustrated in FIGS. 4 and 5. In this embodiment of the invention, the electrode is made similarly to the above-described electrode 30 and consists of an electrode 40 having an elongated body 41 which, in the present instance, is a hollow cylindrical element. The electrode 40 is provided with a string 45 of radially projecting filaments 43 which are interconnected at their base by a connecting strip 44 which is wound helically about the outer circumference of the hollow body 41. In the present embodiment, the string 45 is wound about the body 41 in a close-wound helix. In other respects, the strings 45 of filaments 43 may be identical to the strings 35 of filaments 33 of the first embodiment and further description is deemed unnecessary.

In the second embodiment of the invention, the string 45 is closely wound with little or no spacing between the helical convolutions of the string. The close helical winding of the string 45 about the body 41 tends to impede the flow of oil between the outer periphery of the body 41 and the inner periphery of the pipe 18 adjacent the terminal end 16. To reduce the impedance, the hollow interior 46 of the body 41 provides a flow path from the formation 11 to the pump 24. A limited flow path may be available between the filaments of the string 45. To provide a greater flow in the path between the body 41 and the interior wall of the pipe 18, the contour of the outer perimeter of the electrode may be shaped to provide a clear flow path between the formation and the pump 24. The clear flow path may be achieved by designing the string during assembly with a selected group of the filaments 33 which are shorter than the remaining so as to provide a clearance space between the ends of the selected filaments and the interior wall of the pipe. This additional flow path may be achieved by including selected shorter filaments in the string during assembly of the string. Alternatively, the electrode may be shaped following its manufacture to grind away the outer ends of selected filaments along a path extending throughout the length of the electrode, to thereby provide an additional path which is unimpeded extending from the distal end to the proximal end of the electrode.

Figure 7:
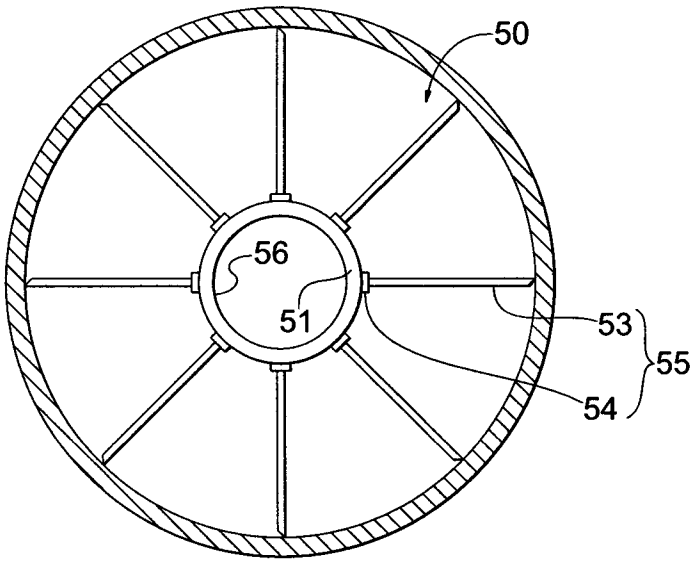
FIG. 7 is a cross sectional view similar to FIG. 3, showing the embodiment shown in FIG. 6.
Figure 6:
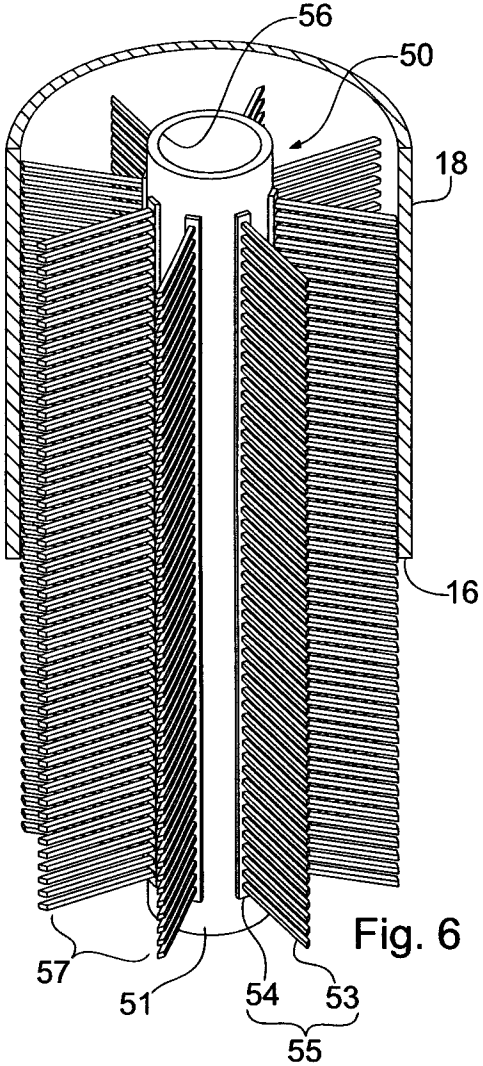
FIG. 6 is a perspective view similar to FIG. 2 of a third embodiment of the invention in which multiple strings of filaments extend axially along the length of the body.

A third embodiment of the invention is illustrated in FIGS. 6 and 7. In this embodiment of the invention, the electrode is made similarly to the above-described electrode 30 and consists of an electrode 50 having an elongated body 51 which, in the present instance, is a hollow cylindrical body. The electrode 50 includes a plurality of strings 55 which extend axially along the outer periphery of the hollow body 51. The strings 55 are formed similarly to the strings 35 and 45 of the previously described embodiments consisting of filaments 53 and a base strip 54. The bases 54 of the strings 55 are spaced about the outer perimeter of the hollow body 51 to provide open channels 57 therebetween which extend the full length of the electrode. The electrode of this embodiment provides less impedance to the flow of oil from the formation 11 to the pump 24. In this embodiment of the invention will also permit the hollow body 51 to be replaced by a solid body (not shown).

Figure 8:
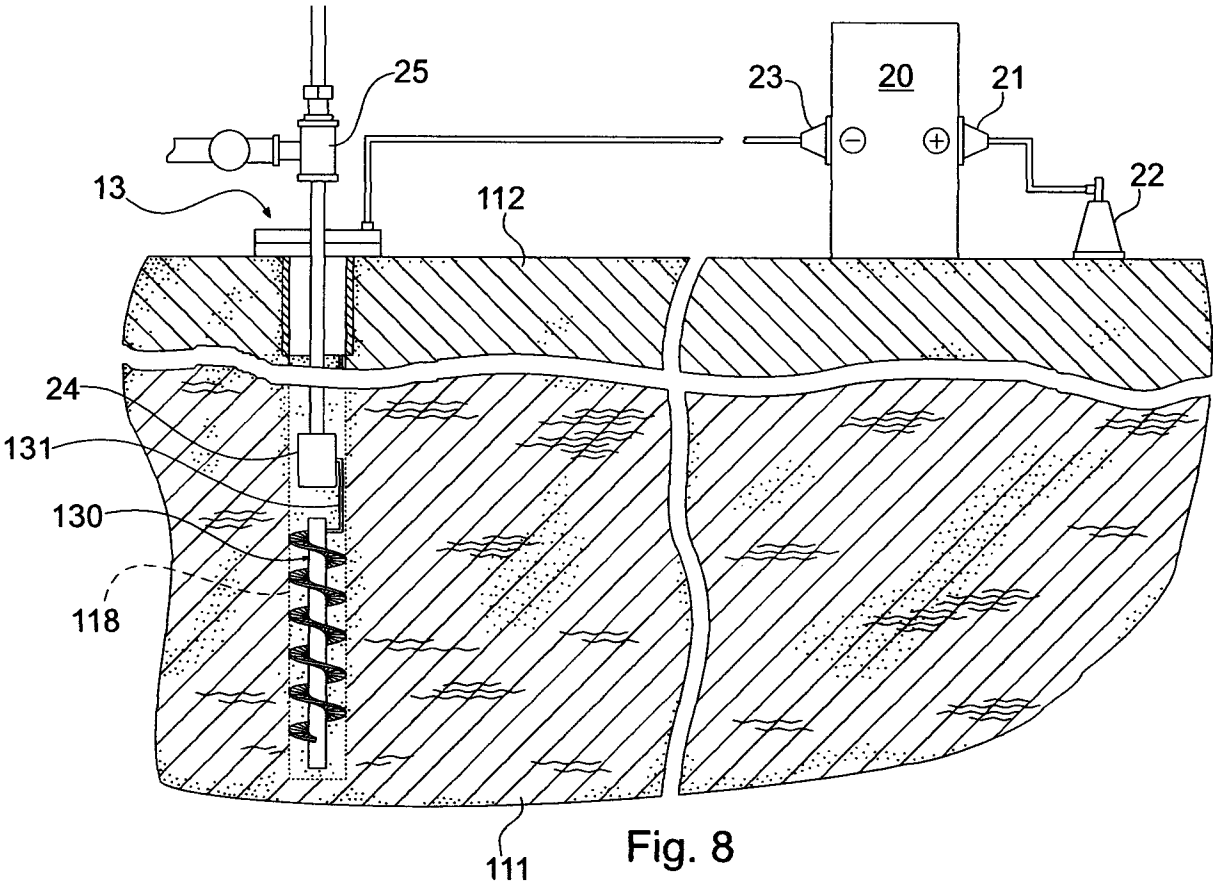
FIG. 8 is a diagrammatic illustration similar to FIG. 1 of an oil field embodying an electrode in accordance with the present invention mounted in the downhole within a consolidated formation.

FIG. 8 illustrates the first embodiment of the invention mounted in the downhole which penetrates in a consolidated formation containing a carbonaceous fluid such as natural gas. In this illustration, the well has a vertical downhole which passes through the overburden 110 into a consolidated formation 111 containing a carbonaceous fluid. The downhole 118 has a terminal end within the formation 111. An electric source 20 has a positive terminal 21 connected to an anode 22, as described above. A negative terminal 23 is connected to the casing of the pump 24. An electrode 130 is connected to the pump casing by an electrical conduit 131. The electrode 130 is similar to the electrode 30 described above but includes a connection to the electrical conduit 131. The electric source 20 generates an electric field within the formation and enhances the flow of oil into the downhole 118 where a pump 24 may be provided to pump the carbonaceous fluid from the formation to conventional machinery 25 at the head of the well for collecting the product for refining and/or distribution. The pointed ends of the filaments of the electrode 130 create a plurality of electrical stress points throughout the length of the electrode 130 which attract the electrical charge which provides the electrical field within the formation. In this embodiment, as in each of the three embodiments of electrode shown in FIGS. 1-7, the electrode provides passageways for the flow of carbonaceous fluid within the downhole.

All of the embodiments of the present invention are effective to enhance the electrical field created by the anode and the cathode of the source 20. The electrode may be retro-fitted to an existing well to improve the recovery of carbonaceous fluid from the underground formation.

While particular embodiments of the present invention have been illustrated and described, it is not intended to limit the invention to such disclosure but changes and modifications may be made therein and thereto within the scope of the following claims.

The invention claimed is:

1. An electrode for use in a downhole extending into an underground formation containing carbonaceous fluid, the electrode serving as a cathode cooperating with a remote anode to provide an electrical charge creating an electric field through at least a portion of the underground formation surrounding said downhole, said electrode comprising an elongated body adapted to be inserted into the downhole in the formation, said electrode having a plurality of radially projecting filaments of electrically conductive material extending outwardly around the body, said radial filaments being electrically interconnected at their inner ends and being free to flex at their radial outer ends, the radial outer ends of the filaments of said body having points operable to dig into the formation and create electrical stress points adapted to attract the electrical charge from said anode.

2. The electrode of claim 1, wherein said radial filaments are spaced-apart to provide a passageway for the carbonaceous fluid between the filaments outwardly of said body.

3. The electrode of claim 1, wherein said radial filaments are interconnected at their inner ends to provide at least one electrically conductive string of filaments.

4. The electrode of claim 3 wherein said string is helically wound about the outer perimeter of said body.

5. The electrode of claim 4, wherein said support strip is openly wound about said body to provide a series of spaced-apart convolutions, adjacent convolutions providing an open helical passageway affording passage of the carbonaceous fluid along the length of said body.

6. The electrode of claim 4, wherein said support strip is closely wound about said body.

7. The electrode of claim 3, including a plurality of strings extending axially along said body and being spaced apart about the outer surface of said body to provide axial passageways in the spacing between said strings.

8. The electrode of claim 1, wherein said body is hollow to provide a passageway for the carbonaceous fluid within said body.

9. The electrode of claim 1 for use in field in which the carbonaceous fluid is oil, said filaments being of composed of an electrically conductive material which is resistant to degradation by oil.

10. An electrode for an oil field downhole having a downhole with at least one open end in a formation containing a carbonaceous fluid, in combination with an electrical source having an anode remote from the downhole and having a cathode connected to the electrode said source being operable to create an electric field in the formation to enhance the flow of the carbonaceous fluid from the field into said open end;

said electrode being of electrically-conductive material and adapted to be positioned in the downhole and in the formation;

said electrode comprising a plurality of resilient electrically conductive filaments having pointed ends projecting radially outward from said body, said plurality of filaments extending radially from said elongated body into the formation, thereby enhancing the electrical field and the flow of electricity from said cathode to said anode.

11. An electrode of a system for use in a well drilled into an unconsolidated formation that includes a carbonaceous fluid, a production pipe extending from the head of the well into the unconsolidated formation, at least the terminal end of the production pipe having a hollow wall with an open end for the collection of the carbonaceous fluid from the formation, and a pump for collecting the fluid and directing it to the head of the well for collection, and an electrode mounted in the open end of said production pipe and extending into the unconsolidated formation, wherein the electrode comprises:

an elongated body and a plurality of filaments projecting substantially radially from said body along its length, said radial filaments being of an electrically conductive material and adapted to project into said unconsolidated formation, and being electrically connected to one another, wherein said electrode defines at least one passageway for fluid extending along the length of the electrode and affording flow of carbonaceous fluid from the formation through the passageway to the pump.

12. The electrode of claim 11, wherein said elongated body is hollow to provide a passageway for the carbonaceous fluid collected from the formation.

13. The electrode of claim 11 wherein said filaments are interconnected to form an string of filaments disposed in an open helical form surrounding said body, said string having convolutions spaced apart to define a helical path as a passageway for the carbonaceous fluid.

14. The electrode of claim 11 wherein said filaments are interconnected to form an string of filaments disposed in an closed helical form surrounding said body, said string having closely-spaced convolutions, said filaments being spaced apart to provide a passageway for the carbonaceous fluid between the filaments.

15. The electrode of claim 11, wherein said filaments are interconnected to form a plurality of strings of filaments, said strings being disposed in axial rows spaced apart about the perimeter of said elongated body to provide gaps, said gaps extending substantially longitudinally of the electrode to provide a longitudinal channel serving as said passageway for the flow of fluid.

16. The electrode of claim 11, wherein the system includes an electric source having a cathode connected to said production pipe and an anode mounted adjacent to said unconsolidated formation remote from the head of the well, wherein said elongated body with filaments is connected to said cathode to cooperate with said anode to create an electrical charge through at least a part of the formation, said body having a proximal end adapted to be positioned in the hollow open end of the pipe and a distal end adapted to project from the pipe into the unconsolidated formation, said radial filaments being electrically interconnected at their inner ends and being free to flex at their outer ends, the outer ends of the filaments at the proximal end of the body having points operable to dig into the hollow open end of the pipe, and the outer ends of the filaments at the distal end of said body having electrical stress points in the unconsolidated formation adapted to attract the electrical charge from the anode.

17. The electrode of claim 16, in which the terminal end of said production pipe is electrically conductive and is connected to said power source, whereby said filaments of said electrode provide an electrically conductive path from said electrode to said cathode.

18. The electrode of claim 16, wherein said pipe serves as an electrical conduit adapted to extend from said electrode to said power source, said filaments of said electrode and said electrical conduit providing a continuous electrical path from said formation to the power source.

* * * * *